US007361872B2

(12) United States Patent
Cole

(10) Patent No.: US 7,361,872 B2
(45) Date of Patent: Apr. 22, 2008

(54) VARIABLE SERVING SIZE INSULATED PACKAGING

(75) Inventor: Lorin R. Cole, Larsen, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/204,457

(22) Filed: Aug. 16, 2005

(65) Prior Publication Data

US 2007/0039951 A1 Feb. 22, 2007

(51) Int. Cl.
*H05B 6/80* (2006.01)

(52) U.S. Cl. ..... 219/725; 219/728

(58) Field of Classification Search ..... 219/725, 219/726, 727, 728, 729, 730, 731, 732, 733, 219/734, 735

See application file for complete search history.

(56) References Cited

U.S. PATENT DOCUMENTS 4,196,331 A * 4/1980 Leveckis et al. ..... 219/728
4,228,945 A 10/1980 Wysocki
4,260,060 A 4/1981 Faller
4,267,420 A 5/1981 Brastad
4,268,738 A 5/1981 Flautt, Jr. et al.
4,286,136 A 8/1981 Mason, Jr.
4,574,174 A 3/1986 McGonigle
4,678,882 A 7/1987 Bohrer et al.
4,745,249 A 5/1988 Daniels
4,775,771 A 10/1988 Pawlowski
4,785,937 A 11/1988 Tamezawa et al.
4,810,844 A 3/1989 Anderson
4,865,921 A 9/1989 Hollenberg
4,883,936 A 11/1989 Maynard et al.
4,890,439 A 1/1990 Smart
4,916,280 A 4/1990 Havette
4,936,935 A 6/1990 Beckett
4,950,859 A 8/1990 Anderson
4,962,293 A 10/1990 Lackey
4,963,424 A 10/1990 Beckett
5,003,142 A * 3/1991 Fuller ..... 219/730
5,034,234 A 7/1991 Andreas et al.
5,041,325 A 8/1991 Larson et al.
5,053,594 A 10/1991 Thota et al.
5,081,330 A 1/1992 Brandberg et al.
5,084,601 A 1/1992 Andreas et al.
5,093,364 A 3/1992 Richards
5,096,723 A 3/1992 Turpin
5,117,078 A 5/1992 Beckett
5,124,519 A 6/1992 Roy et al.
5,164,562 A 11/1992 Huffman et al.
5,177,332 A 1/1993 Fong
5,213,902 A 5/1993 Beckett
5,217,768 A 6/1993 Walters et al.
5,221,419 A 6/1993 Beckett
5,231,268 A 7/1993 Hall et al.

(Continued)

FOREIGN PATENT DOCUMENTS

DE 201 18 105 U1 10/2002

(Continued)

*Primary Examiner*—Daniel Robinson
(74) *Attorney, Agent, or Firm*—Womble Carlyle Sandridge & Rice, PLLC

(57) ABSTRACT

A package for heating a microwave food item is provided.

27 Claims, 9 Drawing Sheets

U.S. PATENT DOCUMENTS 5,239,153 A 8/1993 Beckett
5,256,846 A 10/1993 Walters
5,260,537 A 11/1993 Beckett
5,266,386 A 11/1993 Beckett
5,294,763 A 3/1994 Chamberlain et al.
5,317,118 A * 5/1994 Brandberg et al. ..... 219/727
RE34,683 E 8/1994 Maynard
5,334,820 A 8/1994 Risch et al.
5,340,436 A 8/1994 Beckett
5,354,973 A 10/1994 Beckett
5,389,767 A 2/1995 Dobry
5,405,663 A 4/1995 Archibald et al.
5,410,135 A 4/1995 Pollart
5,424,517 A 6/1995 Habeger
5,484,984 A 1/1996 Gics
5,489,766 A 2/1996 Walters et al.
5,510,132 A 4/1996 Gallo, Jr.
5,519,195 A 5/1996 Keefer
5,543,606 A 8/1996 Gics
5,565,125 A 10/1996 Parks
5,585,027 A 12/1996 Young
5,628,921 A 5/1997 Beckett
5,672,407 A 9/1997 Beckett
5,690,853 A 11/1997 Jackson et al.
5,759,422 A 6/1998 Schmelzer
5,773,801 A 6/1998 Blamer et al.
5,780,824 A 7/1998 Matos
5,800,724 A 9/1998 Habeger
5,994,685 A 11/1999 Jackson et al.
6,060,095 A 5/2000 Scrimager
6,060,096 A 5/2000 Hanson et al.
6,100,513 A 8/2000 Jackson et al.
6,114,679 A 9/2000 Lai
6,137,098 A 10/2000 Moseley et al.
6,150,646 A 11/2000 Lai
6,204,492 B1 3/2001 Zeng
6,251,451 B1 6/2001 Zeng
6,342,693 B1 * 1/2002 Smith et al. ..... 219/756
6,414,290 B1 * 7/2002 Cole et al. ..... 219/759
6,433,322 B2 8/2002 Zeng
6,448,542 B2 * 9/2002 Wong et al. ..... 219/732
6,455,827 B2 9/2002 Zeng
6,501,059 B1 12/2002 Mast
6,534,755 B1 3/2003 Paulucci
6,552,315 B2 4/2003 Zeng
6,677,563 B2 1/2004 Lai
6,683,289 B2 * 1/2004 Whitmore et al. ..... 219/730
6,717,121 B2 4/2004 Zeng
6,744,028 B2 * 6/2004 Chisholm et al. ..... 219/730
6,765,182 B2 * 7/2004 Cole et al. ..... 219/730
6,818,873 B2 11/2004 Savage et al.
7,019,271 B2 * 3/2006 Wnek et al. ..... 219/730
7,022,959 B2 * 4/2006 Cole et al. ..... 219/759
2003/0066831 A1 4/2003 Paulucci
2003/0206997 A1 11/2003 Winkelman et al.
2004/0173607 A1 9/2004 Blankenbeckler et al.

FOREIGN PATENT DOCUMENTS

EP 1 325 869 A2 7/2003
GB 2 365 000 A 2/2002
JP 10 276903 10/1998
WO WO 00/35770 6/2000
WO WO 03/066435 A2 8/2003

* cited by examiner

VARIABLE SERVING SIZE INSULATED PACKAGING

BACKGROUND

Many frozen food items intended for heating in a microwave oven are packaged in cartons or other packaging that enhance the effect of the microwave energy. However, many of such food items are packaged in a single carton that cannot be reused if the user wishes to consume less than the entire amount of food in the package. In such instances, the user must heat the entire food product, consume the desired amount, and re-heat or discard the remaining product. Unfortunately, the quality of the food item reheated in another container may be compromised.

SUMMARY

Various aspects of the present invention are directed generally to a package and a method of making a package that conveniently allows a user to determine how much of the food item to heat and consume. The package includes a plurality of individual serving packages joined by a perforation or other feature that allows the individual serving packages to be separated easily.

DESCRIPTION

The present invention may be best understood by referring to the following figures. For purposes of simplicity, like numerals may be used to describe like features. However, it should be understood use of like numerals is not to be construed as an acknowledgement or admission that such features are equivalent in any manner.

Figure 1:
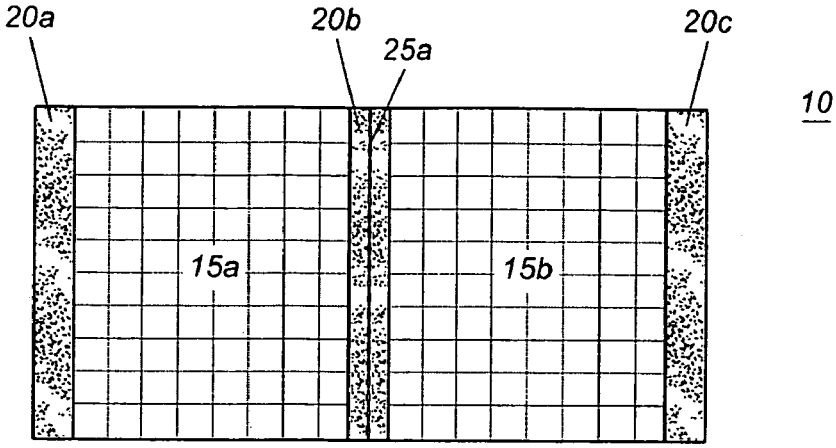
FIG. 1 depicts an exemplary package that may be formed according to the present invention.
Figure 2:
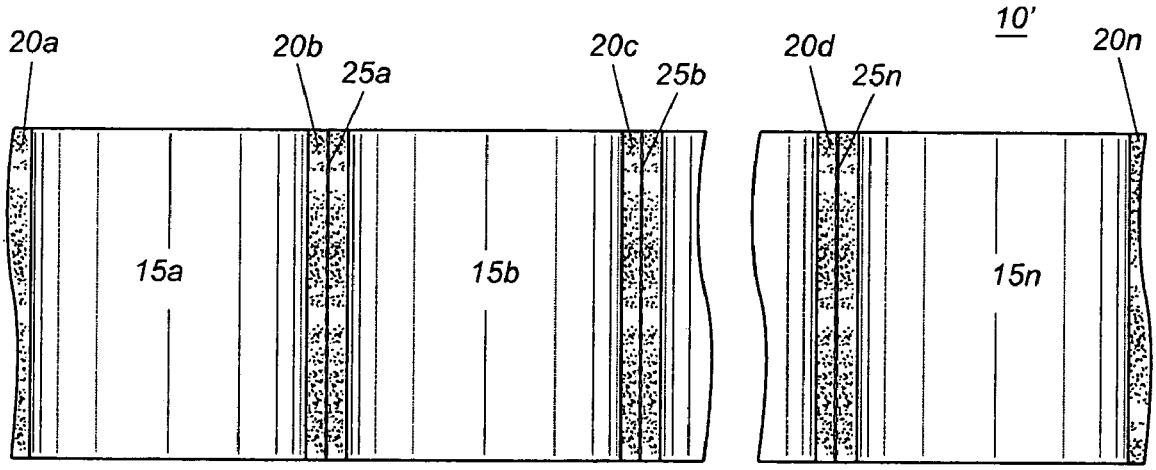
FIG. 2 depicts another exemplary package that may be formed according to the present invention.

FIGS. 1 and 2 depict exemplary packages that may be formed according to the present invention. The packages 10, 10' include a plurality of individual servings or segments 15*a*, 15*b*, . . . 15*n*. Thus, the term "package" may be used to refer to one segment or a plurality of substantially attached segments. Each segment is formed from a substantially continuous sheet of packaging material divided by seals 20*a*, 20*b* . . . 20*n* that may be formed using heat, an adhesive, or any other thermal, chemical, or mechanical technique known to those of skill in the art. Within the seal, a perforation line 25*a*, 25*b* a tear strip (not shown), or other feature for separating the segments 15*a*, 15*b*, . . . 15*n* may be provided.

Figure 3A:
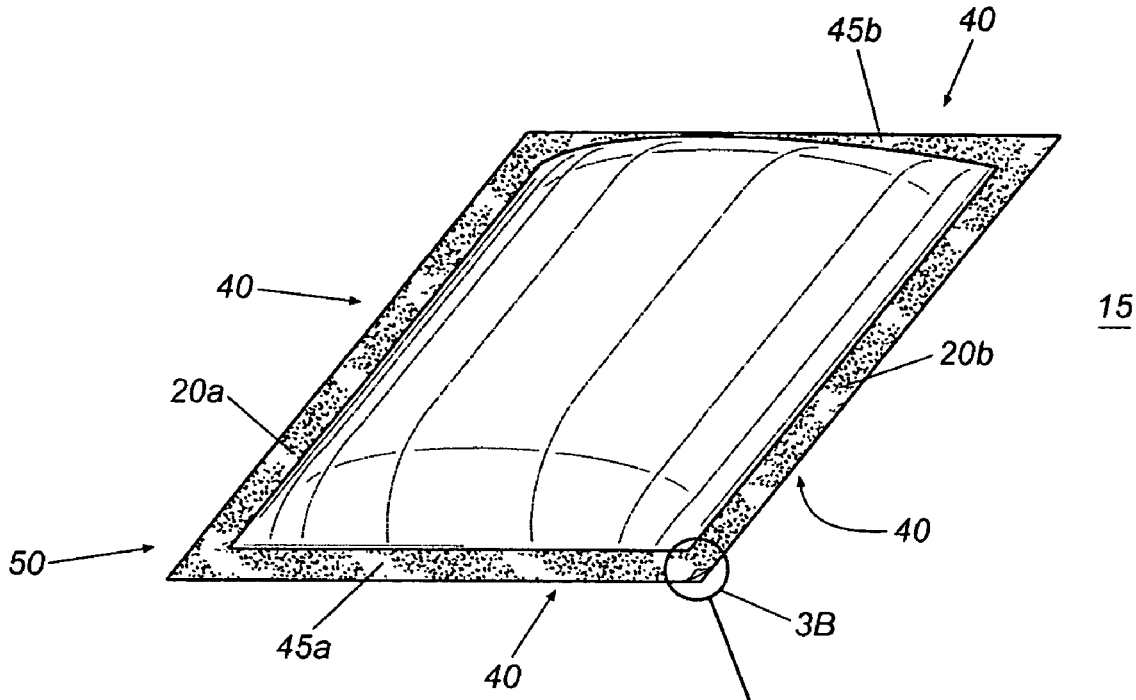
FIG. 3 depicts yet another exemplary package that may be formed according to the present invention.
Figure 3B:
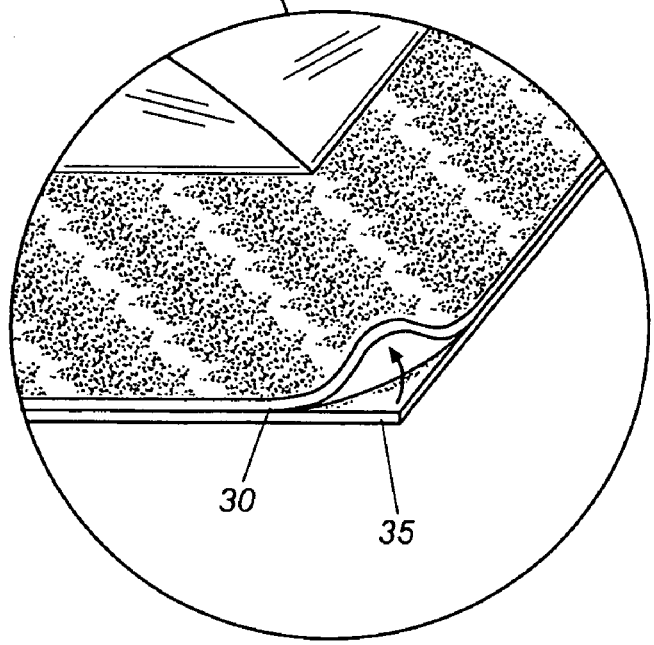

As shown in FIG. 3, each segment 15 includes a first panel 30 and a second panel 35 joined by one or more dividing seals 20*a*, 20*b* and one or more end seals 45*a*, 45*b* along the periphery 40 of each panel. The first panel 30 and the second panel 35 may be joined using any suitable means, for example, adhesive, thermal bonding, or mechanical fastening. One or more portions of the periphery 40 may be provided with features that allow the sealed portion, for example, end seal 45*a* to be opened for removal of the food from a cavity (not shown) therein. In one aspect, at least a portion of the package includes an end portion 50 that can be opened by grasping the first panel 30 and the second panel 35 proximate the end portion 50 and pulling them apart, thereby exposing the food item inside.

Figure 4:
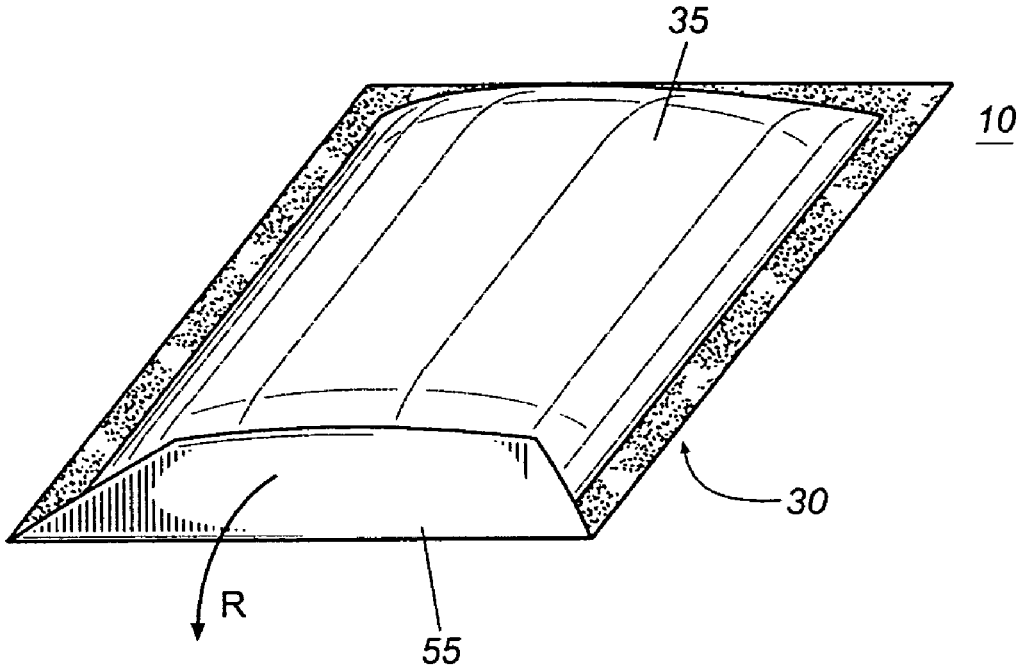
FIG. 4 depicts still another exemplary package that may be formed according to the present invention.
Figure 5:
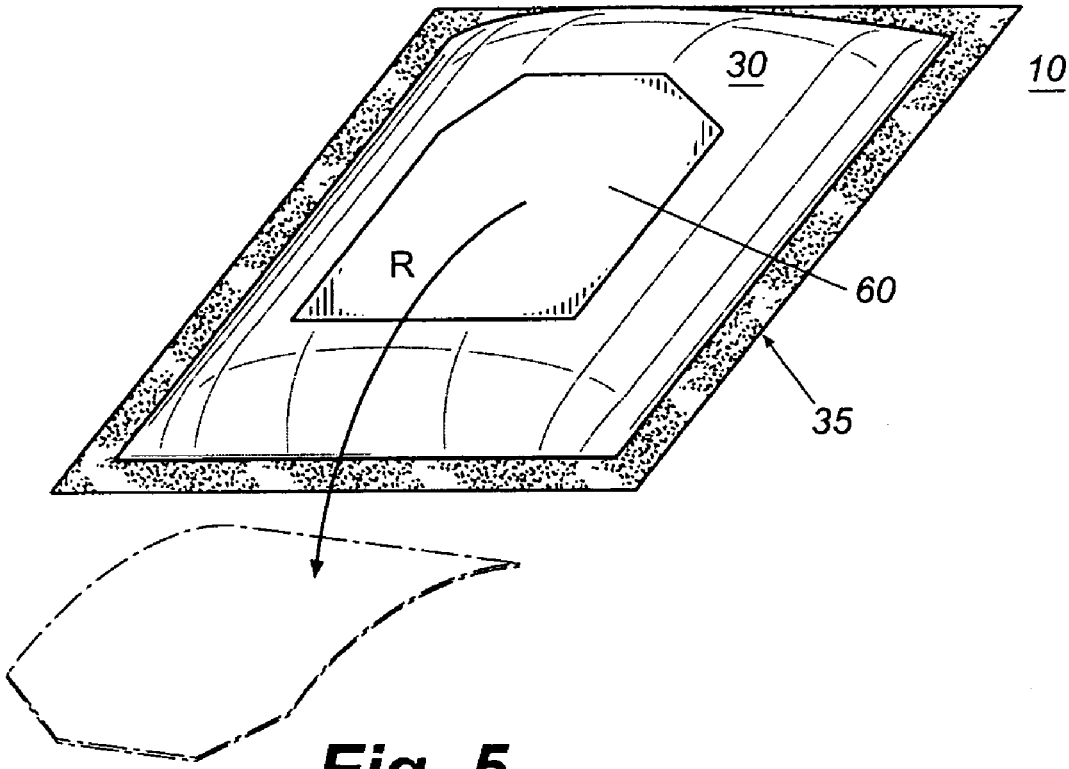
FIG. 5 depicts yet another exemplary package that may be formed according to the present invention.
Figure 6:
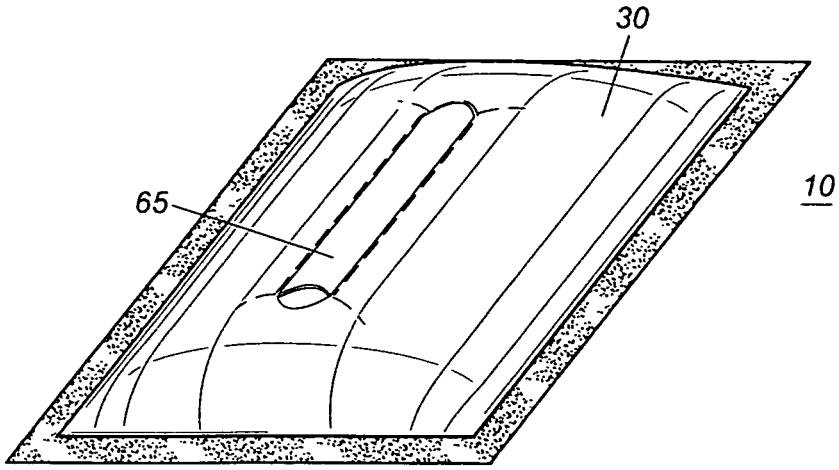
FIG. 6 depicts another exemplary package that may be formed according to the present invention.
Figure 7:
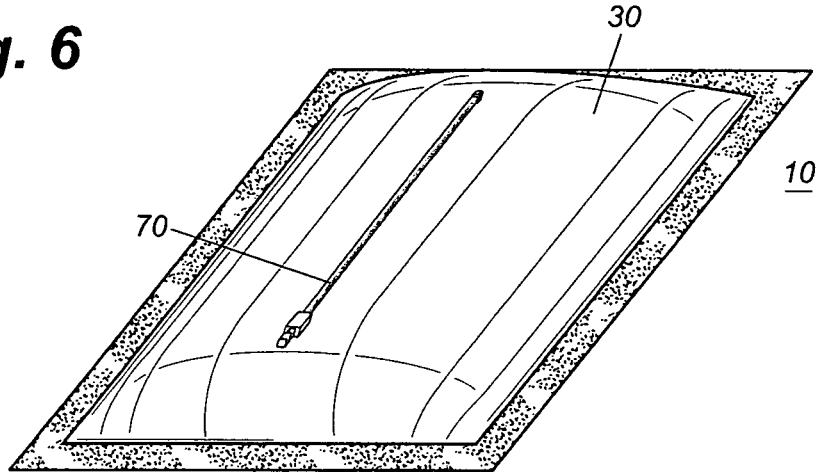
FIG. 7 depicts yet another exemplary package that may be formed according to the present invention.

In another aspect shown in FIG. 4, a removably adhered flap 55 may extend from the first panel 30 over an opening (not shown) to the second panel 35 for sealing the package 10. Thus, to open such a package, the flap 55 is lifted and extended in a direction R away from the package 10, thereby exposing the opening (not shown). In still another aspect shown in FIG. 5, such a flap 60 may extend from one portion of the first panel to another portion of the first panel. As above, such a package is opened by lifting the flap in a direction R away from the package. In yet another aspect, the package 10 may include a perforated tear strip 65 (FIG. 6) or zipper 70 (FIG. 7) in the first panel or the second panel. With such packages, the panel is opened by tearing of the panel along the perforation, or by pulling the tear strip, as needed. Other opening features are contemplated hereby.

By packaging a food item in a package formed according to the present invention, a consumer is able to determine how many portions he or she would like to consume. Thus, for example, a consumer may tear off one serving, two servings, or more as desired. Further, the packaging of the present invention provides convenient apportioning between multiple consumers. Thus, for example, where two people are planning to consume the food item, each can select the number of portions to heat. Further still, by dividing the total amount of food into individual servings, those wishing to monitor caloric intake are able to do so more readily. The package may provide the number of calories per serving, so the user may heat a single serving or a multiple thereof. The package may be divided into individual segments before, during, or after heating. After heating, the package may be removed from the microwave oven. If not already separated, the package may be separated into individual segments.

Figure 8:
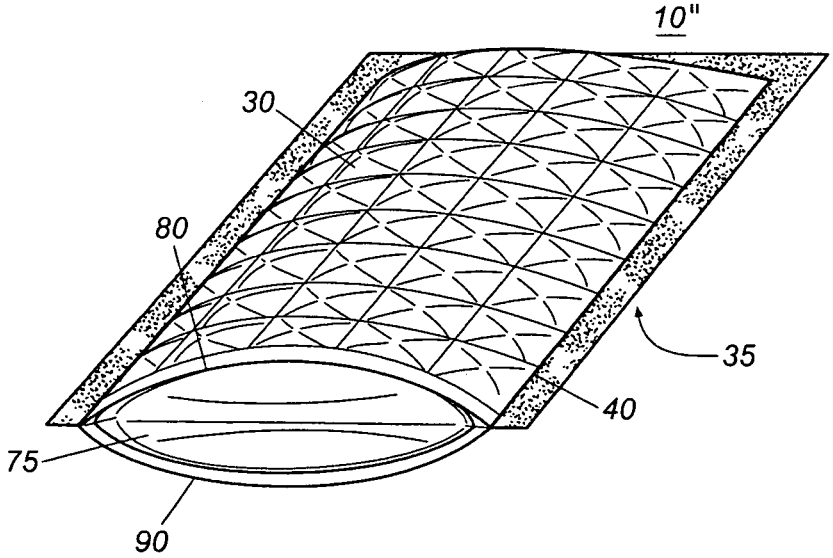
FIG. 8 depicts still another exemplary package that may be formed according to the present invention, made from an insulating microwave material.

If desired, the package may include features that permit each segment to be maintained in an upright configuration after opening. For example, as shown in FIG. 8, the package 10" may include a first panel 30 and a second panel 35 joined along at least a portion of the periphery 40 thereof, and a third panel 75 joined to the first panel 30 along a first edge 80 and joined to the second panel 35 along a second edge 90. When the package is opened and held in an upright position (not shown), the third panel serves as a bottom panel of the package. Such a package can be placed on a table, on the seat of a car, or in any other suitable location without toppling. The package also may include features for venting each segment.

The exemplary packages shown herein have a square or rectangle configuration and are shown to be hand-held type packages. However, it should be understood that other shapes and configurations are contemplated by the present invention. Examples of other shapes encompassed hereby include, but are not limited to, polygons, circles, ovals, cylinders, prisms, spheres, polyhedrons, and ellipsoids. The shape of the package may be determined largely by the shape of the food product, and it should be understood that different packages are contemplated for different food products, for example, sandwiches, pizzas, French fries, soft pretzels, pizza bites, cheese sticks, pastries, doughs, and so forth. Likewise, the package may include gussets, pleats, or any other feature needed or desired to accommodate a particular food item and/or portion size. Additionally, it should be understood that the present invention contemplates packages for single-serving portions and for multiple-serving portions, and is not restricted to hand-held packages. It also should be understood that various components used to form the packages of the present invention may be interchanged. Thus, while only certain combinations are illustrated herein, numerous other combinations and configurations are contemplated hereby.

Figure 9:
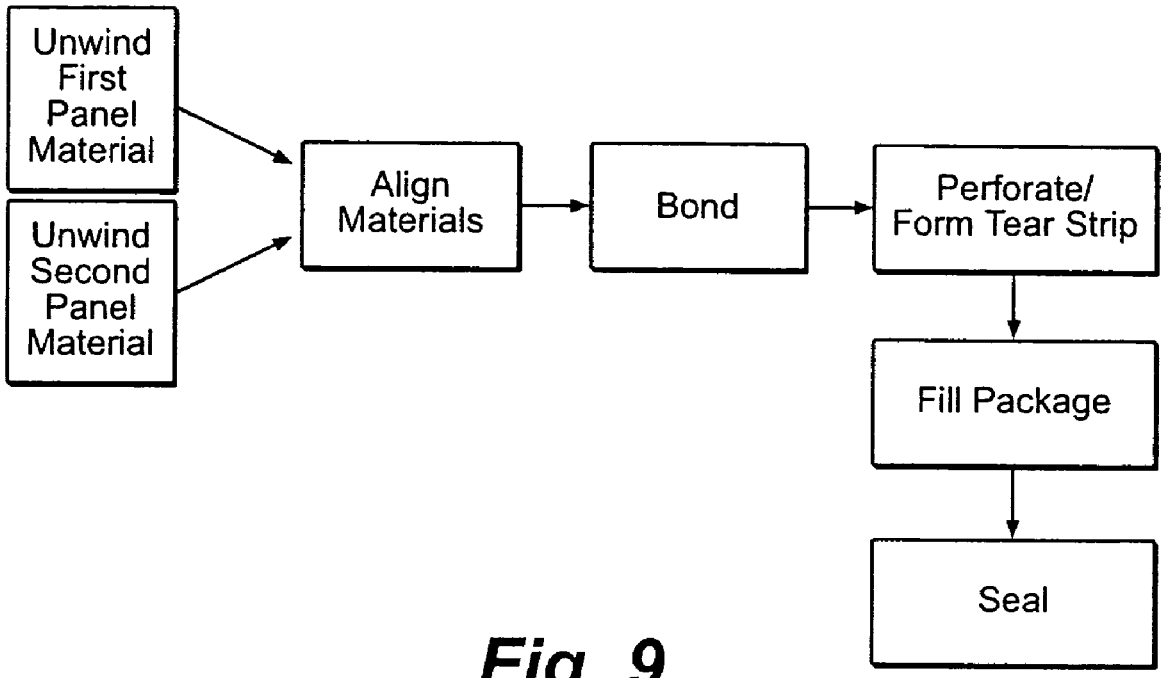
FIG. 9 illustrates an exemplary process that may be used to form a package that may be formed according to the present invention.
Figure 10:
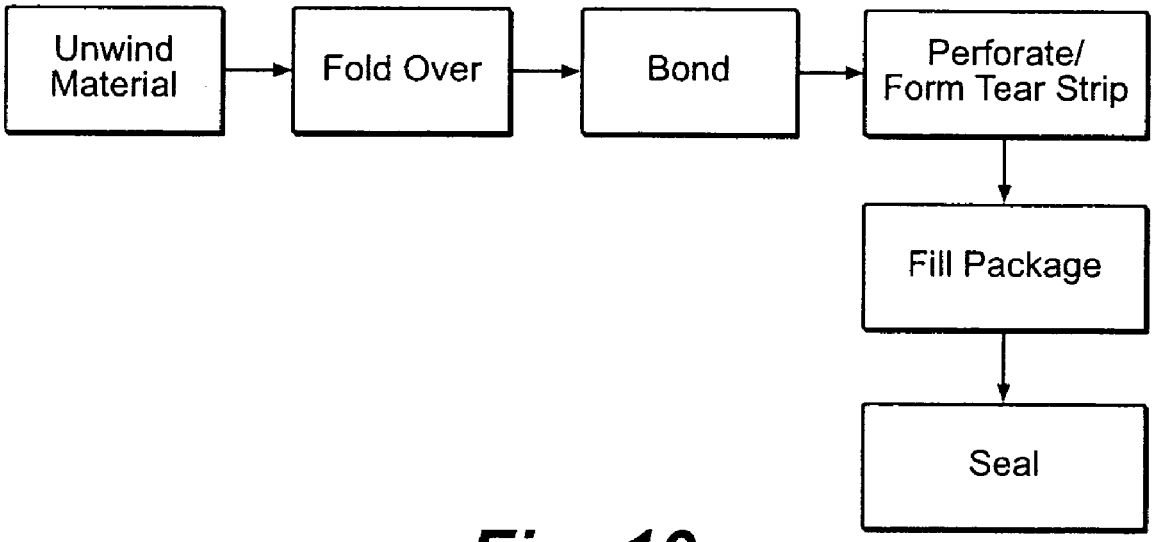
FIG. 10 illustrates another exemplary process that may be used to form a package that may be formed according to the present invention.

The packages of the present invention may be constructed in any suitable manner. Thus, for example, as shown in FIG. 9, to form a two-panel package, the first panel and the second panel may be unwound from rolls of stock material. The panels may be aligned as desired, and bonded as needed to form seals along a portion of the periphery thereof. A portion of the periphery typically is left unsealed to form an opening through which a food item can be inserted. The opening then can be sealed. It should be understood that the food may be inserted through an opening that differs from the opening used by the consumer to access the heated food item. Thus, in one example, the food item may be inserted through an opening formed by the first panel and the second panel, and may be removed through a perforation or tear strip in either the first panel or the second panel. In another example illustrated in FIG. 10, the package may be formed from a single roll of stock material that is subject to a folding process to create the first and second panel. The remainder of the process may be similar to that described above.

Any of the packages or cartons described herein or contemplated hereby may include features that enhance the heating or cooking of the food item. For example, any of the packages may be formed from one or more microwave energy interactive materials that promote browning and/or crisping of the food item during microwave heating. In one aspect, the interior of the package includes a microwave energy interactive material that promotes browning and/or crisping of the food item during microwave heating, for example, a susceptor material. Depending on the microwave energy interactive material selected and its positioning in the packaging, the susceptor may absorb microwave energy, transmit microwave energy, or reflect microwave energy as desired for a particular food item.

A susceptor used in accordance with the present invention may comprise a microwave energy interactive material deposited on or supported by a substrate. The microwave energy interactive material may comprise an electroconductive or semiconductive material. According to one aspect of the present invention, the microwave energy interactive material may comprise a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination thereof.

While metals are inexpensive and easy to obtain in both vacuum deposited or foil forms, metals may not be suitable for every application. For example, in high vacuum deposited thickness and in foil form, metals are opaque to visible light and may not be suitable for forming a clear microwave package or component. Further, the interactive properties of such vacuum deposited metals for heating often are limited to heating for narrow ranges of heat flux and temperature. Such materials therefore may not be optimal for heating, browning, and crisping all food items. Additionally, for field management uses, metal foils and vacuum deposited coatings can be difficult to handle and design into packages, and can lead to arcing at small defects in the structure.

If desired, the microwave interactive energy material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, or a combination thereof. To form the susceptor, ITO typically is sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

The substrate used in accordance with the present invention typically comprises an electrical insulator, for example, a polymeric film. The thickness of the film may typically be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

According to one aspect of the present invention, the polymeric film may comprise polyethylene terephthalate. Examples of polyethylene terephthalate film that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK WAVE® Focus susceptor and the MICRO-RITE® susceptor, both available from Graphic Packaging International (Marietta, Ga.).

According to another aspect of the present invention, the package may include materials that provide a water barrier, oxygen barrier, or a combination thereof. Such barrier layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 66, coextruded nylon 6/EVOH/nylon 6, silicon oxide coated film, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.).

Still other barrier films include silicon oxide coated films, such as those available from Sheldahl Films (Northfield, Minn.). Thus, in one aspect, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 cc/m$^2$/day. In one aspect, the barrier film has an OTR of less than about 10 cc/m$^2$/day. In another aspect, the barrier film has an OTR of less than about 1 cc/m$^2$/day. In still another aspect, the barrier film has an OTR of less than about 0.5 cc/m$^2$/day. In yet another aspect, the barrier film has an OTR of less than about 0.1 cc/m$^2$/day.

The barrier film may have a water vapor transmission rate (WVTR) as measuring using ASTM F1249 of less than about 100 g/m$^2$/day. In one aspect, the barrier film has a water vapor transmission rate (WVTR) as measuring using ASTM F1249 of less than about 50 g/m$^2$/day. In another aspect, the barrier film has a WVTR of less than about 15 g/m$^2$/day. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating, circles, loops, hexagons, islands, squares, rectangles, octagons, and so forth. Examples of alternative patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921, and Re. U.S. Pat. No. 34,683; each of which is incorporated by reference herein in its entirety. Although particular examples of the microwave energy interactive material are shown and described herein, it should be understood that other patterns of microwave energy interactive material are contemplated by the present invention.

The susceptor then may be laminated to the material that forms the package, for example, a paper or paperboard. The paperboard may have a thickness of about 8 to about 28 mils. In one aspect, the paperboard support has a thickness of about 10 to about 20 mils. In another aspect, the paperboard support has a thickness of about 13 mils.

If desired, the package may be coated or laminated with other materials to impart other properties, such as absorbency, repellency, opacity, color, printability, stiffness, or cushioning. Absorbent susceptors are described in U.S. Provisional Patent Application Ser. No. 60/604,637, filed Aug. 25, 2004, incorporated herein by reference in its entirety. Additionally, the support may include graphics or indicia printed thereon.

In another aspect of the present invention, the package includes an insulating microwave material. As used herein, an "insulating microwave material" refers to any arrangement of layers, such as polyester layers, susceptor layers, polymer layers, paper layers, continuous and discontinuous adhesive layers, and patterned adhesive layers that provide an insulating effect. The package may include one or more susceptors, one or more expandable insulating cells, or a combination of susceptors and expandable insulating cells. Examples of materials that may be suitable, alone or in combination, include, but are not limited to, are QwikWave® Susceptor packaging material, QwikWave® Focus® packaging material, Micro-Rite® packaging material, MicroFlex® Q packaging material, and QuiltWave™ Susceptor packaging material, each of which is commercially available from Graphic Packaging International, Inc. For example, FIG. 8 depicts a package using an insulting microwave material with expandable cells. However, any of such materials described above or other insulating materials may be used to form all or a portion of the packages shown in FIGS. 1-8 or contemplated hereby. Examples of such materials are described in PCT Application No. PCT/US03/03779, incorporated by reference herein in its entirety.

In one aspect of the present invention, the insulating microwave material includes at least one susceptor. By using an insulating microwave material with a susceptor, more of the sensible heat generated by the susceptor is transferred to the surface of the food product rather than to the microwave oven environment. Without the insulating material, some or all the heat generated by the susceptor may be lost via conduction to the surrounding air and other conductive media, such as the microwave oven floor or turntable. Thus, more of the sensible heat generated by the susceptor is directed to the food product and browning and crisping is enhanced. Furthermore, insulating microwave materials may retain moisture in the food item when cooking in the microwave oven, thereby improving the texture and flavor of the food item.

Various exemplary insulating materials are depicted in FIGS. 11-16. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 11:
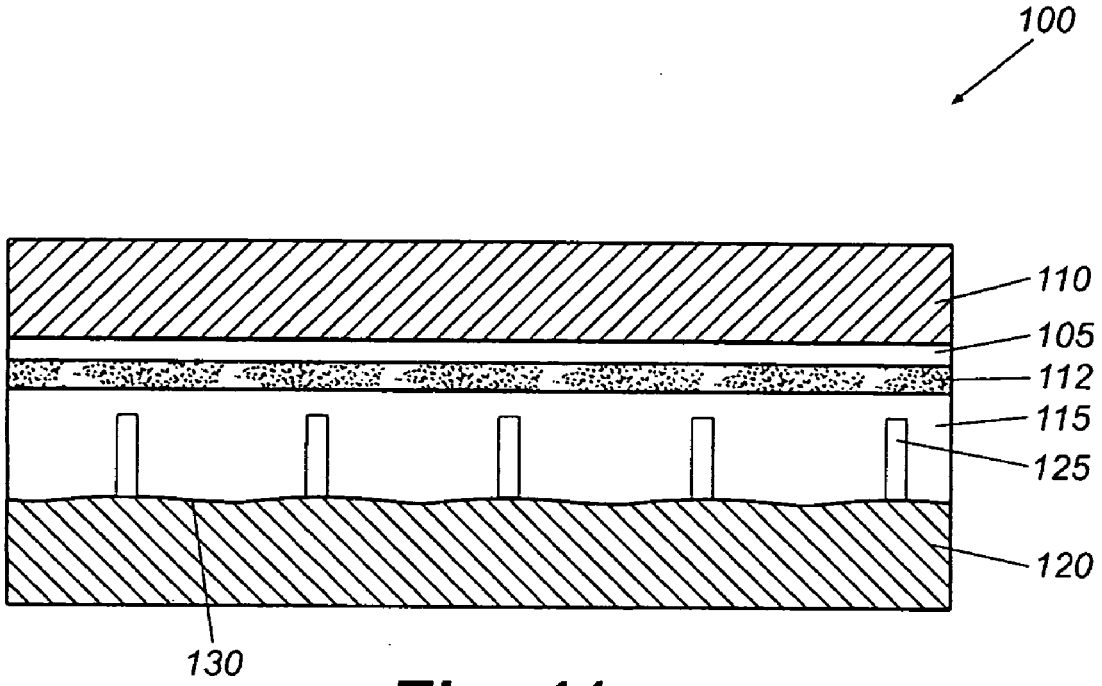
FIG. 11 is a cross-sectional view of an insulating microwave material that may be used with a package according to the present invention.

Referring to FIG. 11, the material 100 may be a combination of several different layers. A susceptor, which typically includes a thin layer of microwave interactive material 105 on a first plastic film 110, is bonded for example, by lamination with an adhesive 112, to a dimensionally stable substrate 115, for example, paper. The substrate 115 is bonded to a second plastic film 120 using a patterned adhesive 125 or other material, such that closed cells 130 are formed in the material 100. The closed cells 130 are substantially resistant to vapor migration.

Figure 12:
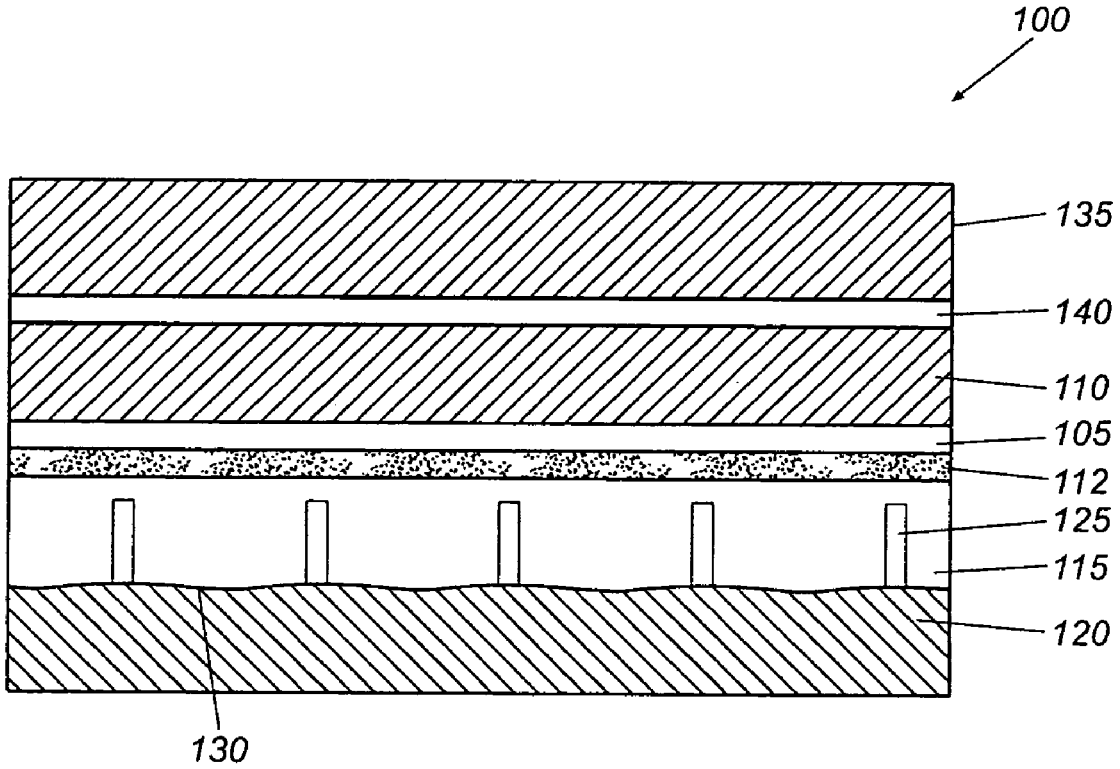
FIG. 12 is a cross-sectional view of an alternative insulating microwave material that may be used with a package according to the present invention.

Optionally, an additional substrate layer 135 may be adhered by adhesive 140 or otherwise to the first plastic film 110 opposite the microwave interactive material 105, as depicted in FIG. 12. The additional substrate layer 135 may be a layer of paper or any other suitable material, and may be provided to shield the food item (not shown) from any flakes of susceptor film that craze and peel away from the substrate during heating. The insulating material 100 provides a substantially flat, multi-layered sheet 150, as shown in FIG. 13.

Figure 13:
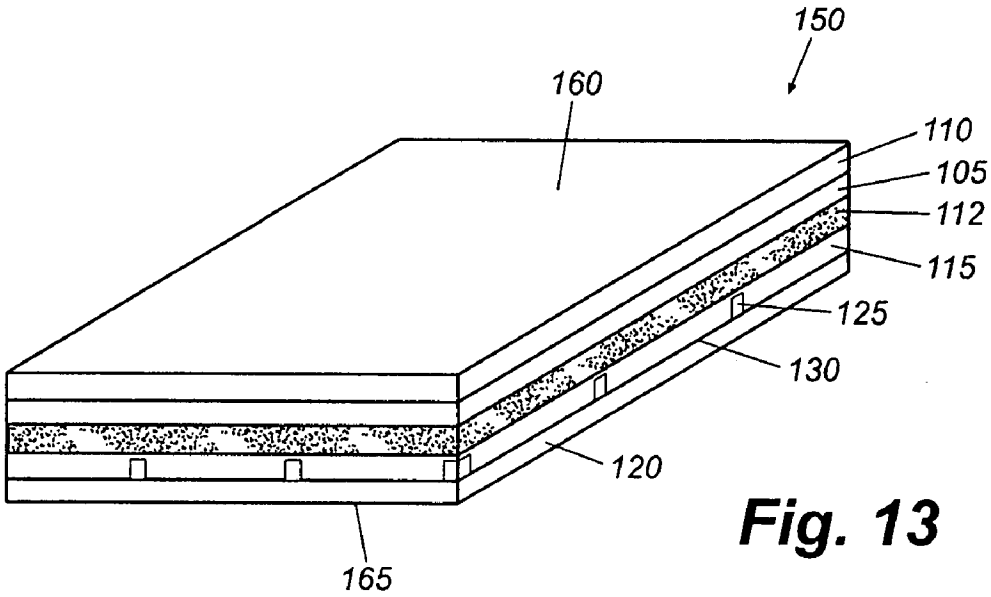
FIG. 13 is a perspective view of the insulating microwave material of FIG. 11.
Figure 14:
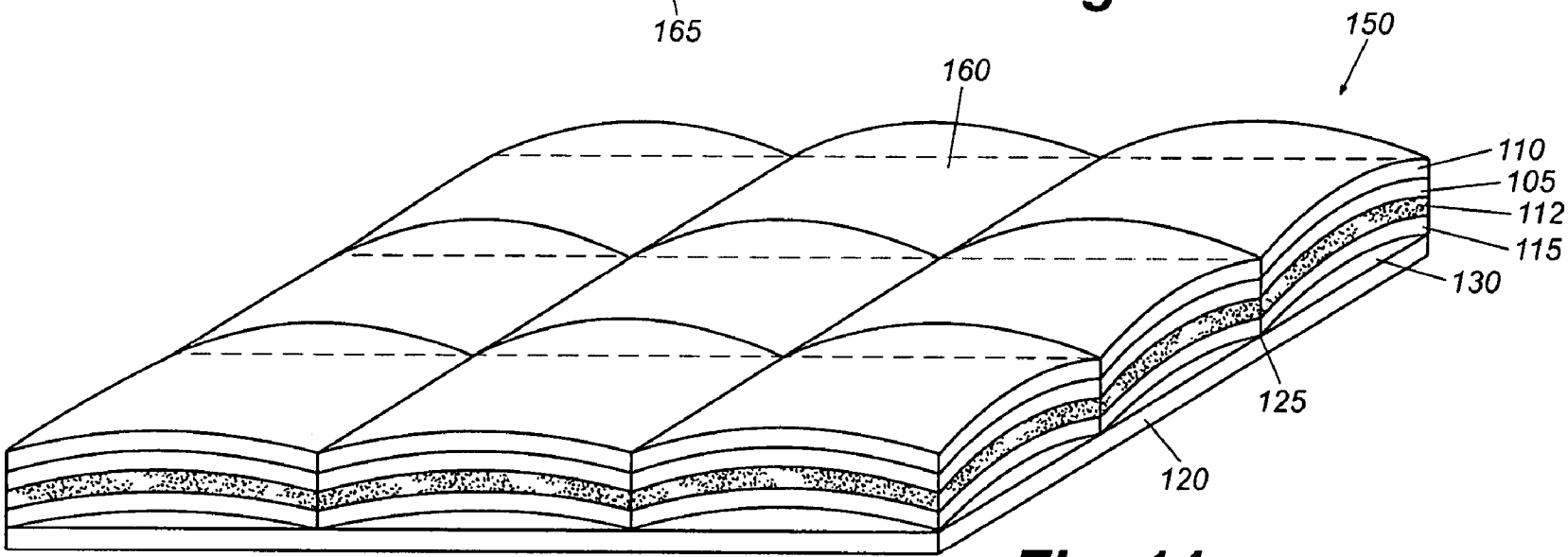
FIG. 14 depicts the insulating microwave material of FIG. 13 after exposure to microwave energy.

FIG. 14 depicts the exemplary insulating material 150 of FIG. 13 after being exposed to microwave energy from a microwave oven (not shown). As the susceptor heats upon impingement by microwave energy, water vapor and other gases normally held in the substrate 115, for example, paper, and any air trapped, in the thin space between the second plastic film 120 and the substrate 115 in the closed cells 130, expand. The expansion of water vapor and air in the closed cells 130 applies pressure on the susceptor film 110 and the substrate 115 on one side and the second plastic film 120 on the other side of the closed cells 130. Each side of the material 100 forming the closed cells 130 reacts simultaneously, but uniquely, to the heating and vapor expansion. The cells 130 expand or inflate to form a quilted top surface 160 of pillows separated by channels (not shown) in the susceptor film 110 and substrate 115 lamination, which lofts above a bottom surface 165 formed by the second plastic film 120. This expansion may occur within 1 to 15 seconds in an energized microwave oven, and in some instances, may occur within 2 to 10 seconds.

Figure 15:
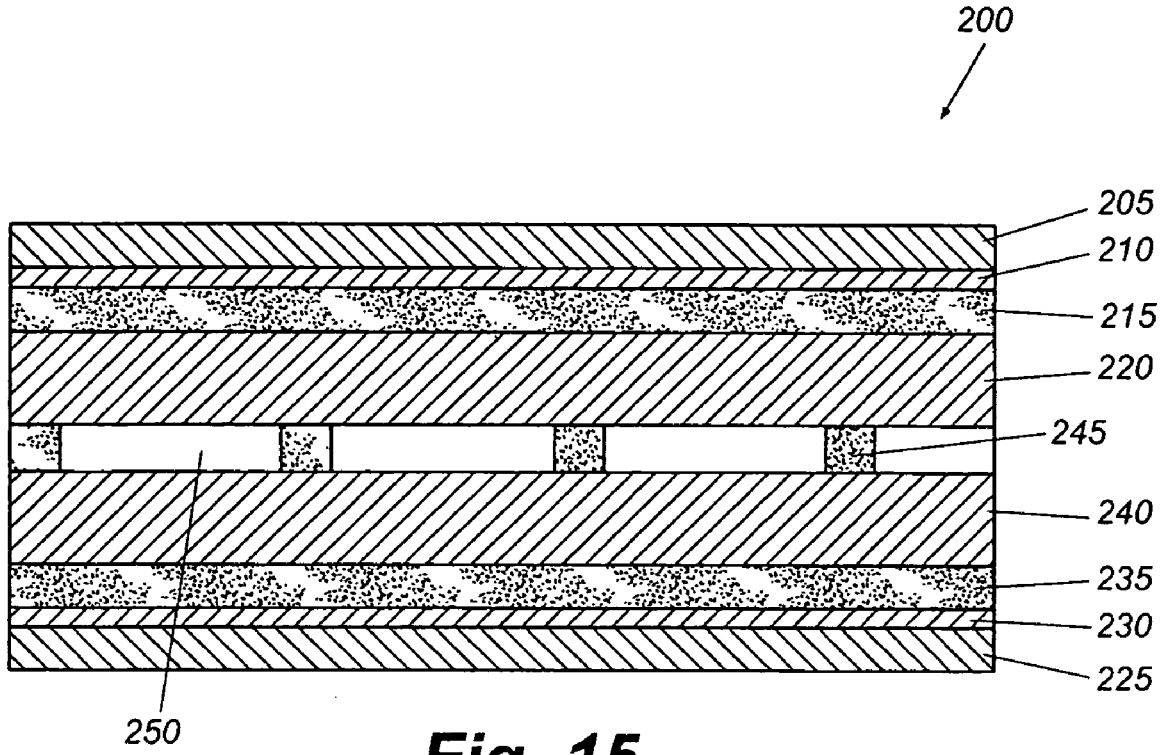
FIG. 15 is a cross-sectional view of yet another insulating microwave material that may be used with a package according to the present invention.
Figure 16:
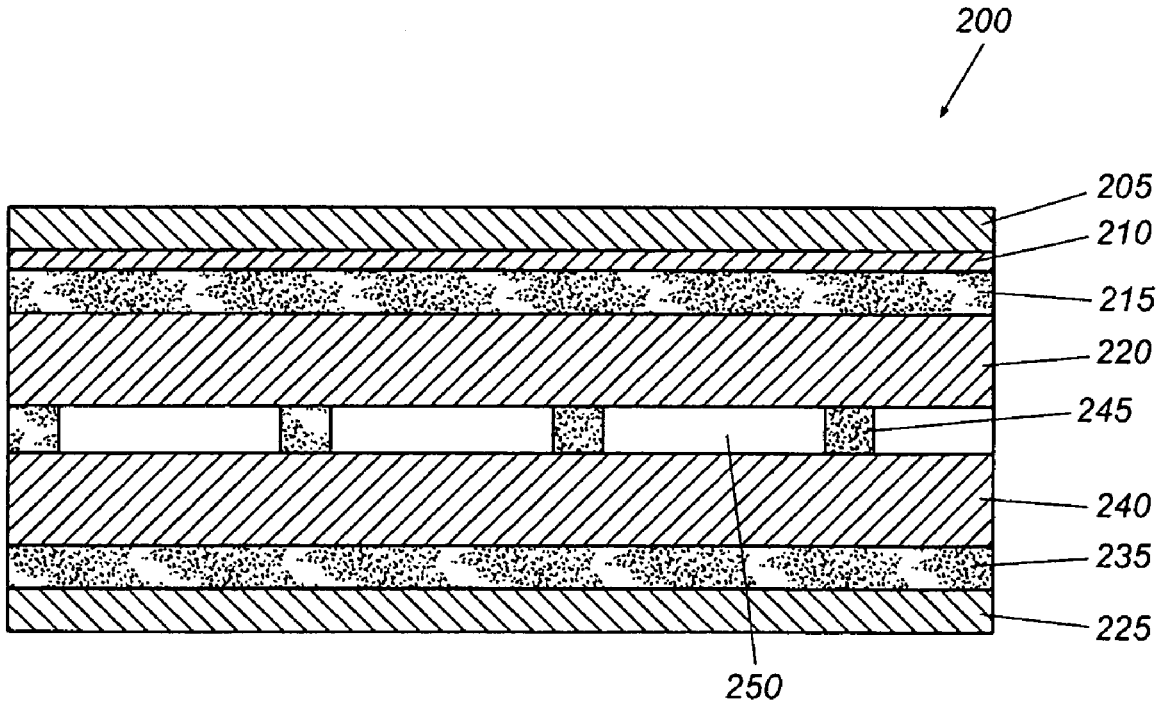
FIG. 16 is a cross-sectional view of still another insulating microwave material that may be used with a package according to the present invention.

FIGS. 15 and 16 depict alternative exemplary microwave insulating material layer configurations that may be suitable for use with any of the various packages of the present invention. Referring first to FIG. 15, an insulating microwave material 200 is shown with two symmetrical layer arrangements adhered together by a patterned adhesive layer. The first symmetrical layer arrangement, beginning at the top of the drawings, comprises a PET film layer 205, a metal layer 210, an adhesive layer 215, and a paper or paperboard layer 220. The metal layer 210 may comprise a metal, such as aluminum, deposited along a portion or all of the PET film layer 205. The PET film 205 and metal layer 210 together define a susceptor. The adhesive layer 215 bonds the PET film 205 and the metal layer 210 to the paperboard layer 220.

The second symmetrical layer arrangement, beginning at the bottom of the drawings, also comprises a PET film layer 225, a metal layer 230, an adhesive layer 235, and a paper or paperboard layer 240. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 245 is provided between the two paper layers 220 and 240, and defines a pattern of closed cells 250 configured to expand when exposed to microwave energy. In one aspect, an insulating material 200 having two metal layers 210 and 230 according to the present invention generates more heat and greater cell loft.

Referring to FIG. 16, yet another insulating microwave material 200 is shown. The material 200 may include a PET film layer 205, a metal layer 210, an adhesive layer 215, and a paper layer 220. Additionally, the material 200 may include a clear PET film layer 225, an adhesive 235, and a paper layer 240. The layers are adhered or affixed by a patterned adhesive 245 defining a plurality of closed expandable cells 250.

Figure 17:
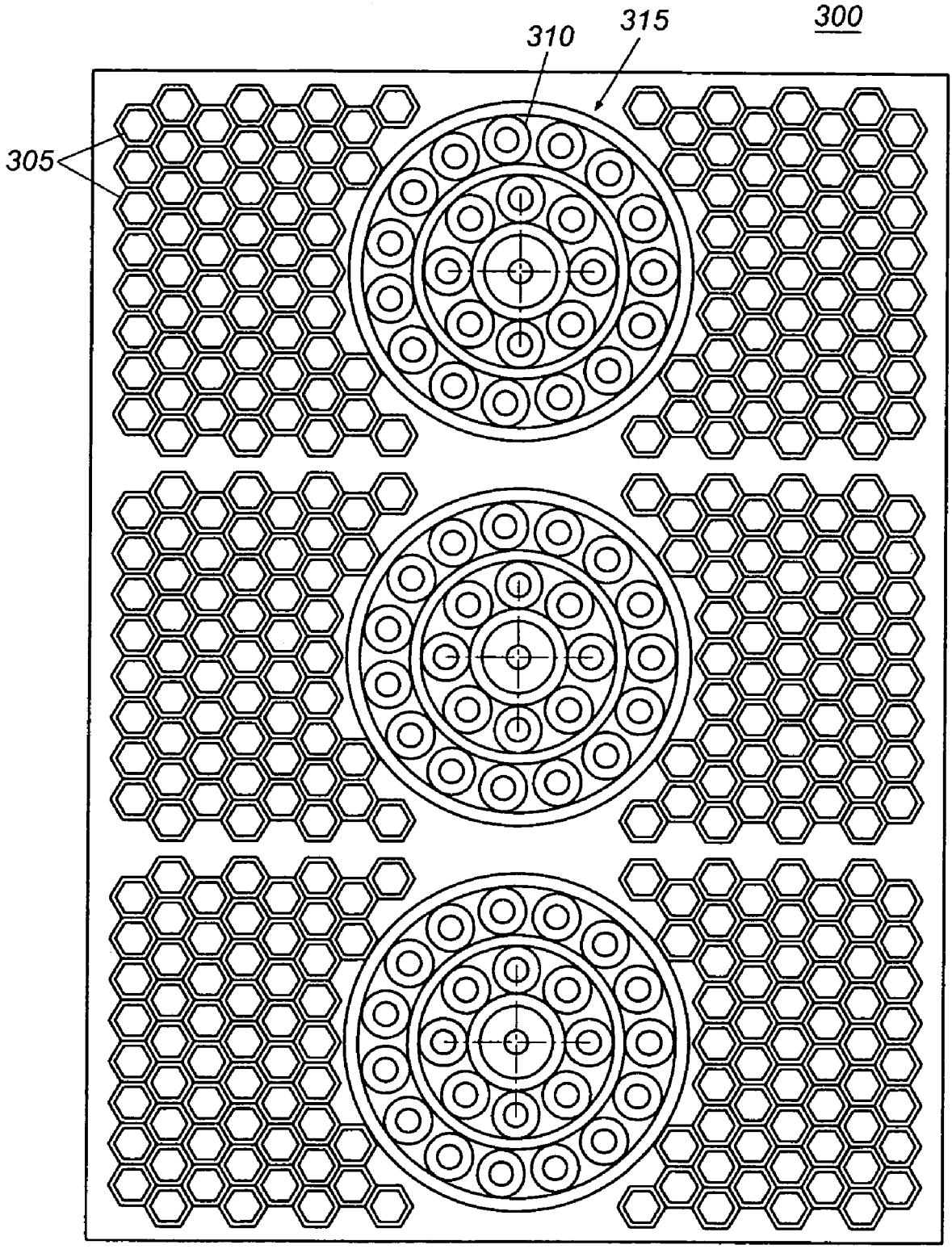
FIG. 17 depicts an exemplary microwave energy interactive material pattern, in triplicate, that may be used with a package according to the present invention.

It will be understood by those of skill in the art that in any of the packages contemplated hereby, the microwave insulating material may include an adhesive pattern that is selected to enhance cooking of a particular food item. For example, where the food item is a single item, for example, a sandwich, the adhesive pattern may be selected to form substantially uniformly shaped expandable cells. Where the food item is a plurality of small items, for example, French fries or tater tots, the adhesive pattern may be selected to form a plurality of different sized cells to allow the individual items to be variably contacted on their upper and side surfaces. An example of one such pattern 300 is illustrated in triplicate in FIG. 17. The pattern 300 includes a plurality of hexagons 305 and a plurality of circles 310 arranged in groups of concentric circles 315. While such examples are provided herein, it will be understood that numerous patterns are contemplated hereby, and the pattern selected will depend on the heating, browning, crisping, and insulating needs of the particular food item and package.

Advantageously, the segments may be packaged and provided to a retailer or consumer in any suitable manner. In one aspect, the package may be provided to the consumer as is, that is, without any additional packaging. In another aspect, the package may be provided to the retailer or consumer within an overwrap, for example, a plastic film package. In yet another aspect, the package may be provided to the retailer or consumer in a carton, for example, a paperboard carton. In any of such aspects, the package may be situated as a "roll" of segments, as a folded stack, as a stack of one or more attached segments, or in any other suitable manner. Thus, the segments and/or package may be configured in any manner desired for aesthetic purposes, to minimize waste, or to optimize manufacturing of the package. For example, a single manufacturing line may be used to prepare cartons including two segments, four segments, and so forth. This provides significant manufacturing benefits over commercially available packages and packaging methods.

Where the package is placed within a carton, the carton may include features that allow for easy dispensing of individual segments. For example, one or more sides of a carton may include a removable panel through which a single segment can be removed. The segments may be attached to other segments or may be stacked as individual segments, as desired. Numerous package and carton configurations are contemplated hereby.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A package for heating a microwave food item comprising:

a plurality of separably joined package segments, each package segment comprising a first panel and a second panel joined along at least a portion of at least two edges of each thereof, the first panel and second panel defining a cavity therebetween, wherein at least a portion of each package segment comprises an insulating microwave material including a layer of microwave energy interactive material supported on a first polymer film, a moisture-containing layer joined to the microwave energy interactive material, and a second polymer film partially joined to the moisture-containing layer, thereby defining a plurality of expandable cells between the second polymer film and the moisture-containing later, wherein the expandable cells are adapted to inflate in response to microwave energy.

2. The package of claim 1, wherein each package segment is separably joined to at least one other package segment by a perforated line.

3. The package of claim 1, wherein each package segment is separably joined to at least one other package segment by a tear strip.

4. The package of claim 1, wherein at least a portion of each package segment comprises a barrier material.

5. The package of claim 1, further comprising an opening feature.

6. The package of claim 1, wherein the package can be opened by grasping the first panel and the second panel proximate the periphery of each and pulling them apart.

7. The package of claim 1, further comprising a removably adhered flap extending from the first panel over an opening to the second panel.

8. The package of claim 1, further comprising a tear strip in at least one of the first panel and the second panel.

9. A package for heating a microwave food item comprising:

a first package segment and a second package segment separably joined along a tear line, each package segment including a cavity defined by at least a first panel and a second panel joined along at least a portion of at least two edges thereof; and a removably adhered flap extending from the first panel over an opening to the second panel, wherein at least a portion of each package segment is formed from a microwave energy interactive insulating material including a layer of microwave energy interactive material supported on a first polymer film, a moisture-containing layer joined to the microwave energy interactive material, and a second polymer film partially joined to the moisture-containing layer, thereby defining at least one expandable insulating cell between the second polymer film and the moisture-containing layer.

10. The package of claim 9, wherein the expandable insulating cell is adapted to at least partially inflate in response to microwave energy.

11. The package of claim 9 in combination with a carton, wherein the carton comprises a plurality of walls and an opening through which at least one of the plurality of separably joined package segments can be removed.

12. A package for heating a microwave food item comprising:

a first segment and a second segment separably joined along a tear line, each segment including a cavity defined by at least a first panel and a second panel joined along at least a portion of a periphery of the first panel and the second panel; and a removably adhered flap extending from the first panel over an opening to the second panel, wherein at least a portion of each segment is formed from a microwave energy interactive insulating material comprising a susceptor bonded to a dimensionally stable substrate, the dimensionally stable substrate being bonded to a plastic film in a pattern defining a plurality of closed cells.

13. The package of claim 12, wherein the closed cells are adapted to expand when exposed to microwave energy.

14. The package of claim 12, in combination with a carton, wherein the carton comprises a plurality of walls and an opening through which one or more of the separably joined segments can be removed.

15. A package for heating a microwave food item comprising:

a plurality of separably joined segments, each segment including a first panel and a second panel joined along at least a portion of a periphery of each thereof; and a third panel having a first edge and a second edge, the third panel joined to the first panel along the first edge, and the third panel joined to the second panel along the second edge, wherein at least a portion of each segment comprises an insulating microwave material including a microwave energy interactive material supported on a first polymeric film layer, a moisture-containing layer superposed with the microwave energy interactive material, and a second polymeric film layer joined to the moisture-containing layer in a predetermined pattern, thereby forming one or more closed cells between the moisture-containing layer and the second polymeric film layer.

16. The package of claim 15, wherein each segment is separably joined to at least one other segment by a perforated line.

17. The package of claim 15, further comprising a removably adhered flap extending from the first panel over an opening to the second panel.

18. A package for heating a microwave food item comprising:

a plurality of separably joined segments, each segment comprising:

a first panel and a second panel joined along at least a portion of a periphery of each thereof; and a third panel having a first edge and a second edge, the third panel joined to the first panel along the first edge, and the third panel joined to the second panel along the second edge, wherein at least a portion of each segment comprises an insulating microwave material, and wherein the insulating microwave material comprises a susceptor bonded to a dimensionally stable substrate, the dimensionally stable substrate being bonded to a plastic film in a pattern defining a plurality of closed cells.

19. The package of claim 18, wherein the closed cells are adapted to inflate in response to microwave energy.

20. The package of claim 18 in combination with a carton, wherein the carton comprises a plurality of walls and an opening through which one or more separably joined segments can be removed.

21. The package of claim 15, wherein the third panel serves as a base panel for supporting the package in an upright configuration.

22. The package of claim 15, wherein the first edge and the second edge of the third panel are arcuate in shape and joined to one another proximate to respective end points.

23. The package of claim 18, wherein the third panel serves as a base panel for supporting the package in an upright configuration.

24. The package of claim 18, wherein the first edge and the second edge of the third panel are arcuate in shape and joined to one another proximate to respective end points.

25. The package of claim 1 in combination with a carton, wherein the carton comprises a plurality of walls and an opening through which one or more separably joined package segments can be removed.

26. The package of claim 1 in combination with a carton, wherein the carton comprises a plurality of walls and an opening through which one or more package segments can be removed, and wherein the package segments are arranged in a stacked configuration.

27. The package of claim 1 in combination with a carton, wherein the carton comprises a plurality of walls and an opening through which one or more package segments can be removed, and wherein the package segments are arranged in a rolled configuration.

* * * * *